United States Patent [19]

Hester

[11] 4,083,075

[45] Apr. 11, 1978

[54] LINT PICKUP DEVICE

[76] Inventor: Michael A. Hester, 169 S. Cedar St., Hazleton, Pa. 18201

[21] Appl. No.: 787,126

[22] Filed: Apr. 13, 1977

[51] Int. Cl.[2] ..... A47L 13/00

[52] U.S. Cl. ..... 15/104 A; 15/231; 242/67.3 R; 294/1 R

[58] Field of Search ..... 15/98, 104 A, 231; 34/95.1, 95.4; 101/332; 197/181, 184, 185; 271/33; 294/1 R

[56] References Cited

U.S. PATENT DOCUMENTS

| | | | |
|---|---|---|---|
| 221,764 | 11/1879 | Asper | 101/332 |
| 1,399,734 | 12/1921 | Baldwin | 107/181 X |
| 1,995,685 | 3/1935 | Perkins | 15/104 A X |
| 2,851,008 | 9/1958 | Rochester | 197/181 X |
| 3,742,547 | 7/1973 | Sohmer | 15/104 A |
| 3,916,470 | 11/1975 | May | 15/98 |

FOREIGN PATENT DOCUMENTS

| | | | |
|---|---|---|---|
| 499,139 | 4/1976 | U.S.S.R. | 15/104 A |

*Primary Examiner*—Daniel Blum
*Attorney, Agent, or Firm*—Jones, Tullar & Cooper

[57] ABSTRACT

A device for removing litter from rugs, carpets, or floors comprises a housing having an elongated handle connected thereto and a tape cartridge disposed therein, the housing further comprising means for selectively advancing the tape in the cartridge to present a tacky surface for contacting and thus removing the litter.

12 Claims, 6 Drawing Figures

LINT PICKUP DEVICE

BACKGROUND OF THE INVENTION

A few specks of lint, thread, crumbs, animal hairs, fuzz, or the like on a carpet or on a bare floor tend to make an otherwise clean room look untidy, and can be the cause of much embarrasement. To avoid this situation, one must either bend over and pick up the litter by hand, if physically able, or haul out a cumbersome and often heavy vacuum cleaner or similar power driven device. As an alternative, one can use a conventional manual carpet sweeper. However, such sweepers normally require a significant expenditure of effort if they are to clean satisfactorily, and they offer little beneficial results when used on bare floors.

Accordingly, it is an object of the present invention to provide a device which may be used to remove lint, thread, crumbs and the like forms of litter from floors, carpets, rugs and the like quickly and easily.

Yet another object is to provide a floor cleaning device which is both light in weight and provided with an elongated handle to facilitate its use by an operator in a standing position.

Yet another object is to provide a cleaning device which employs a tacky material as the means for removing lint, hair and other litter from carpets, rugs, floors and the like.

It is yet another object to provide a floor cleaning device which employs a removable and replaceable cartridge of tape which tape contacts and thereby removes litter.

Another object is to provide a floor cleaning device equipped with means for selectively advancing a tape having a tacky surface for contacting and removing litter.

DESCRIPTION OF THE DRAWING

The above and other objects and advantages of the invention will become more fully apparent as the description thereof proceeds, especially when taken in conjunction with the accompanying drawing wherein.

DETAILED DESCRIPTION

Figure 1:
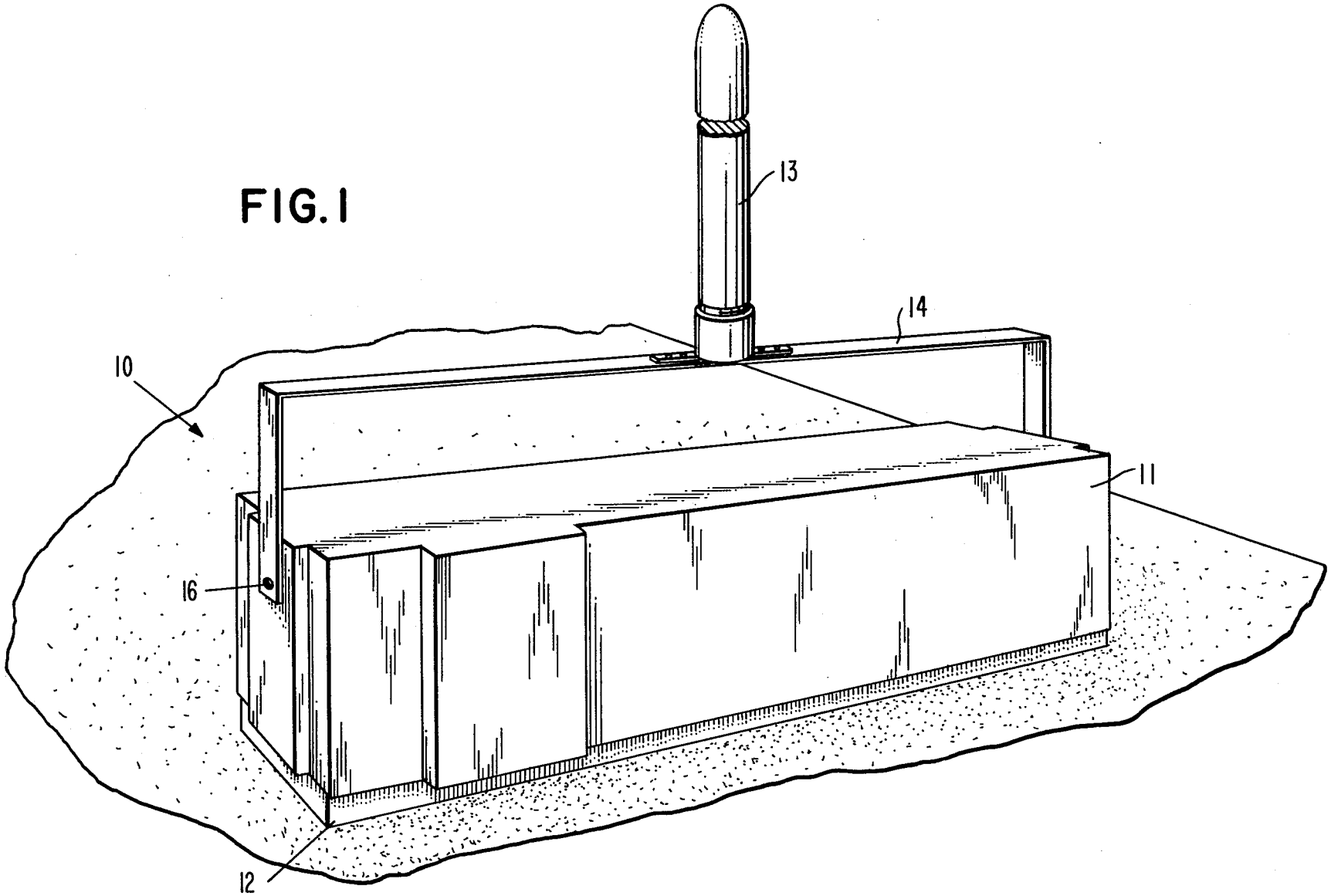
FIG. 1 is a prospective view of the embodiment of the cleaning device in the subject invention.

Referring now to the drawings, and, more particularly, to FIG. 1, there is shown a cleaning device, designated generally as 10. The cleaning device 10 comprises a generally hollow housing 11, a tape cartridge 12 and an elongated handle 13, which handle 13 is suitably mounted to the housing 11 by means of a U-shaped bracket 14 and rivets or other fasteners 16.

The housing 11 is preferably comprised of plastic or relatively thin gauge metal so as to provide a strong, lightweight structure. As can be seen more clearly in FIGS. 2–4, the housing 11 is provided with a spring element 17 and spring clip means 18. As discussed more fully hereinbelow, the spring element 17, which is mounted to the housing by means of pins or suitable fasteners 15 disposed in closed-end slots 20 near the ends of the element 17, cooperates with the tape cartridge 12 to advance the tape from a tape supply reel 27 (FIG. 4) to a tape take-up reel 28 (FIG. 4) whereas the spring clips 18 cooperate with holding tabs 26 (FIG. 4) on the cartridge 12 to hold the cartridge in place within the housing 11. The housing is also provided with a tape advance mechanism comprised of a ratchet rod or rack 19 mounted to a plate 21 which, in turn, is mounted to the front face of the housing 11. Also mounted to the plate 21 for cooperation with the ratchet rod 19 are a pair of cogged wheels 22 and 23 and a lever device 24. The plate 21 is also provided with a channel 25 for receiving the axle of the cogged wheels 22 and 23, thus allowing them to move vertically upwardly within the housing to accommodate the vertical movement of the cartridge 12 when it is retracted relative to the housing.

Figure 4:
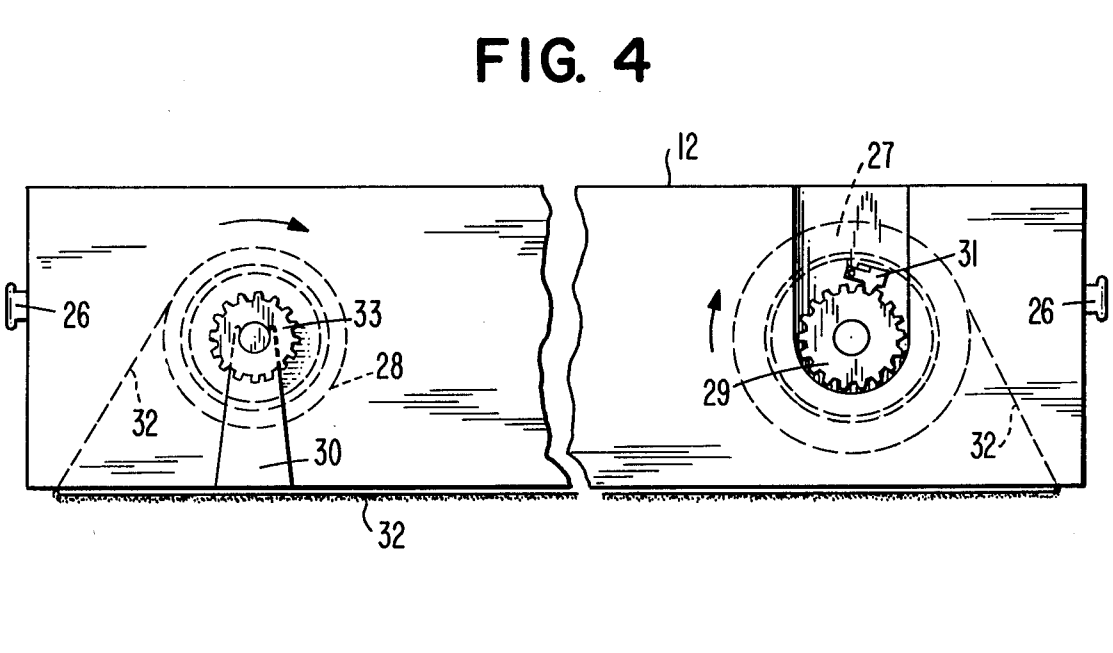
FIG. 4 is a front elevational view of the disposable tape cartridge to be used in the device of FIG. 1 with portions removed and broken away to illustrate the full or supply reel and the empty or tape take-up reel, and the means for advancing them.
Figure 5:
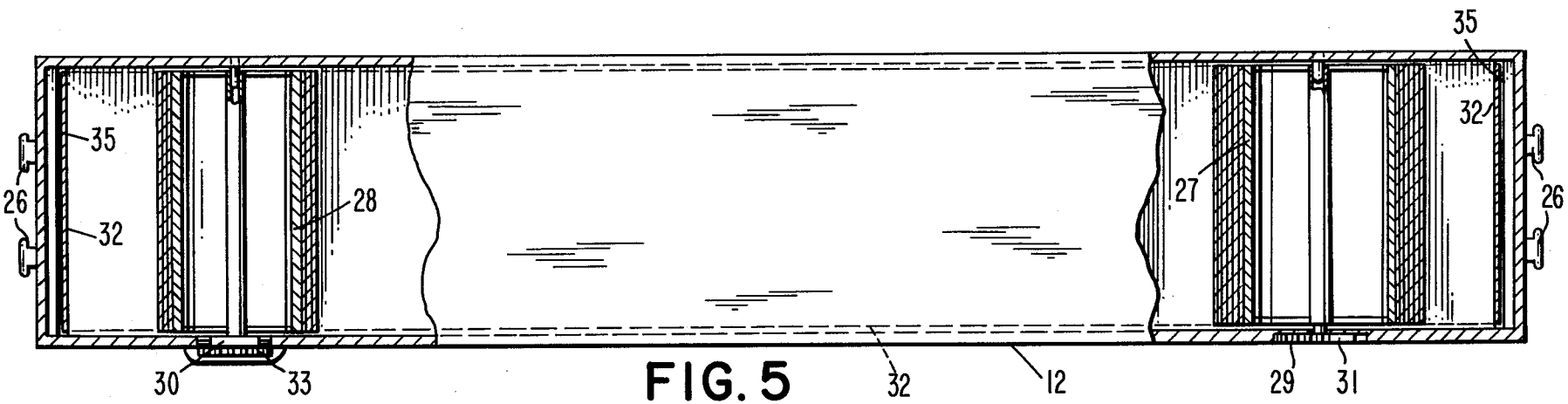
FIG. 5 is a plan view of the tape cartridge with portions of the top removed.

The cartridge 12, as seen most clearly in FIGS. 4 and 5, comprises a plastic or other suitable housing equipped with tab members 26 which are adapted to be held securely by the spring clip means 18 of the cleaner housing 11. The cartridge 12 is also provided with a tape supply reel 27 and an empty or used tape take-up reel 28. The axel of the empty reel 28 is rotatably supported in a frame member 30 and is provided with a cogged wheel 33 which, as discussed more fully hereinbelow, cooperates with the cogged wheel 23, the ratchet rod 19, the channel 25, the lever mechanism 24 and the cogged wheel 22 of the housing 11 to advance fresh tape 32 from the tape supply reel 27 through the opening 35 and in the direction of the arrow. The tape supply reel 27 is also provided with a cogged wheel 29 and a cooperating lever mechanism 31 to prevent undesirable or premature advancement of tape 32 from the supply reel 27 when picking litter from the floor or rugs, the lever mechanism being suitably mounted to the wall of the cartridge housing.

Figure 2:
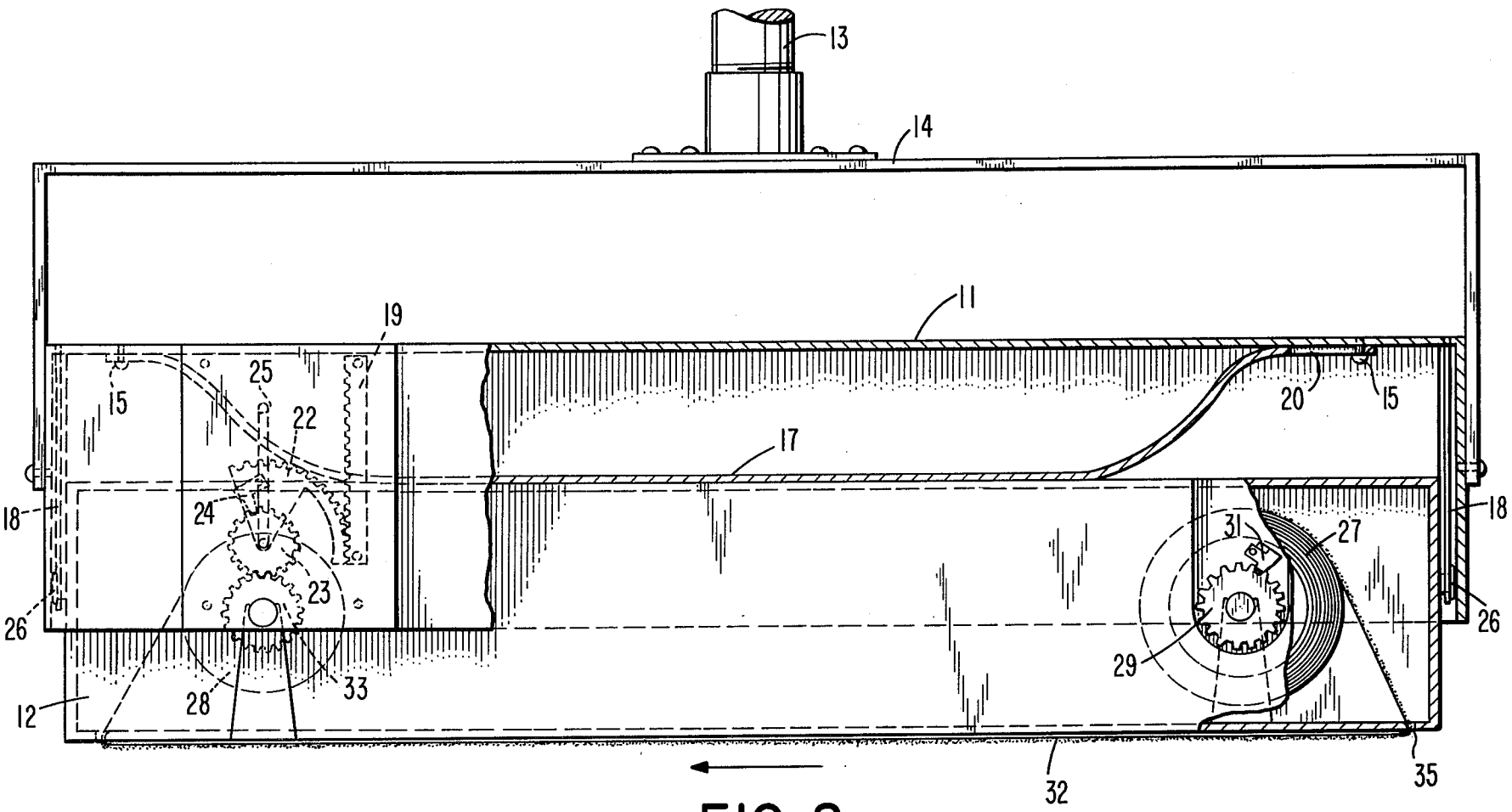
FIG. 2 is a front elevational view of the device of FIG. 1, wherein the front face of the device is removed and the front face of the cartridge is partially removed to illustrate the means for retaining the cartridge within the device and for advancing the tape on the cartridge.
Figure 3:
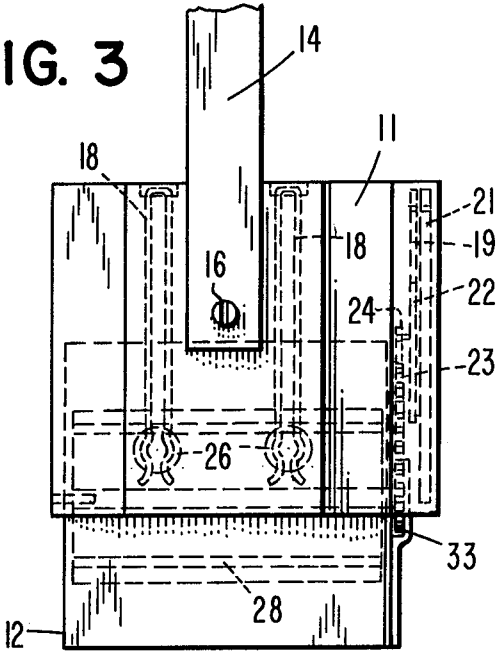
FIG. 3 is a side elevational view of the device of FIG. 1 further illustrating the manner in which the spring clip means are used to hold the tape cartridge in place.
Figure 6:
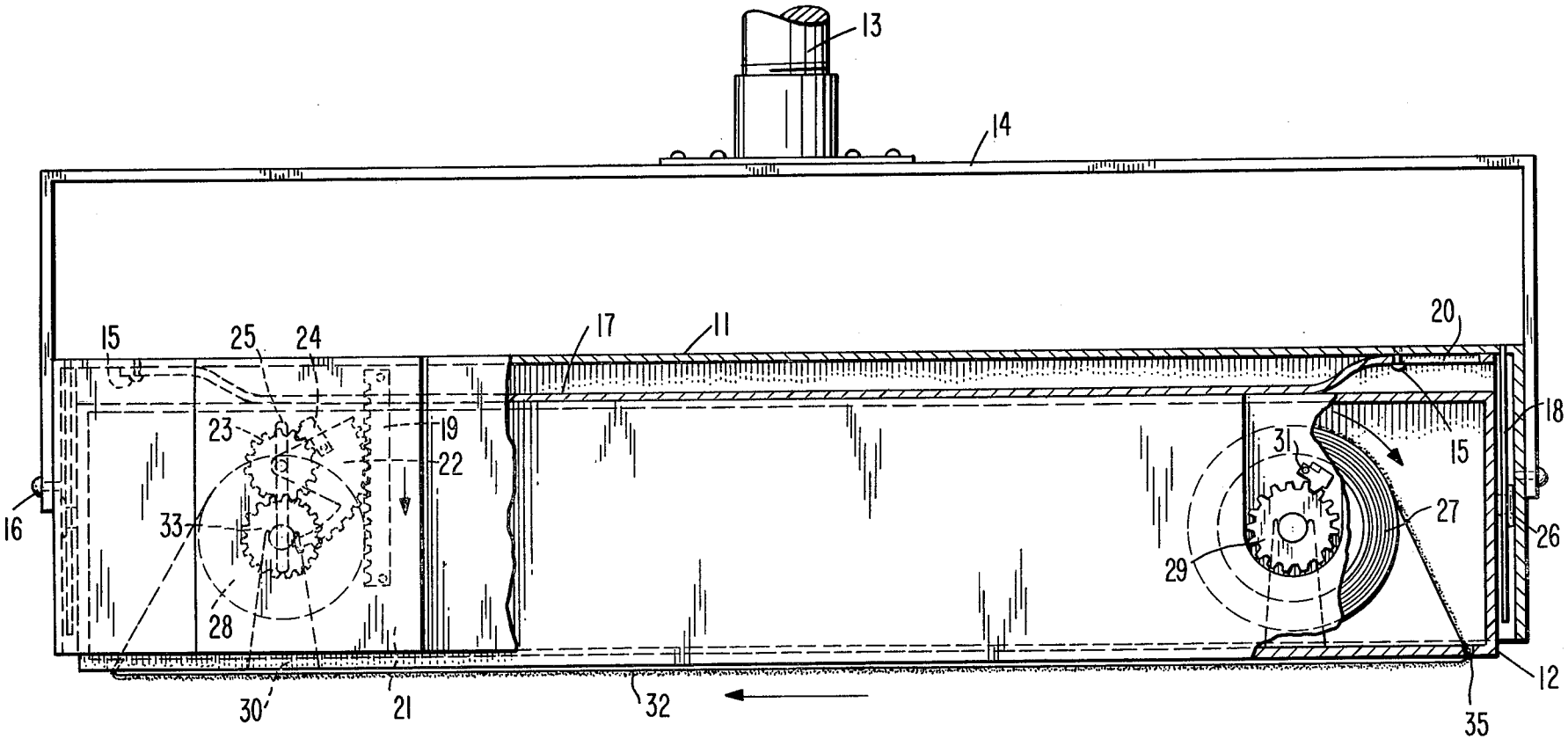
FIG. 6 is a front elevational view, similar to FIG. 2, except that the cartridge is in a depressed position which will cause the tape to be advanced when the downward pressure on the housing is released.

The operation of the present cleaning device is illustrated in FIGS. 2 and 6. Thus, referring to these figures, it is evident that when the tape cartridge 12 is placed within the housing 11 so that the holding tabs 26 are gripped by the spring clip means 18, the spring element 17 forces the bottom of the cartridge, and thus the tape 32, to extend below the bottom of the housing 11. In this position, the device may be used for picking up litter merely by pressing the exposed tape onto the litter by means of the handle 13.

When the exposed portion of the tape 32 becomes dirty or otherwise loses its tackiness, or when for any reason the operator desires to advance the tape, the operator need only press downward on the handle with sufficient force to depress or retract the cartridge into the housing 11. When this is done, the cartridge 12 will retract into the housing against the bias of the spring element 17, causing the ratchet rod 19 to move downward relative to the cogged wheel 22. This causes the cogged wheel 22 to move in the clockwise direction, carrying the lever mechanism in the same direction. The lever mechanism is mounted to the wheel 22 such that it skips over the gears or teeth of cogged wheel 23 when cogged wheel 22 moves in the clockwise direction. On continued retraction of the cartridge into the housing, the common axle of cogged wheels 22 and 23 moves upward in the channel 25 to accomodate the cartridge.

On releasing the downward pressure on the handle 13, the spring element 17 forces the cartridge back out of the housing 11. During this movement of the cartridge, the cogged wheel 22 moves in the counter-clockwise direction, thus moving the lever mechanism in the same direction. The movement of the lever mechanism 24 in the counter-clockwise direction causes the cogged wheel 23 to rotate in the counter-clockwise direction. In turn, the movement of wheel 13 causes the cogged wheel 33 to move in the clockwise direction. This movement, in turn, is transmitted to the tape take-up reel 28 such that the cogged wheel 33 and reel 28 rotate in the clockwise direction and thereby pull a length of tape from the supply reel 27. The length of tape that is supplied with each complete retraction or depression and release of the cartridge depends upon the gear ratio of the respective wheels and ratched rod. However, it is preferred that the ratios are selected such that the tape 32 is advanced from about 1–3 inches with each depression. In this manner, a full clean tape can be advanced with about 4–6 pushing strokes on the cartridge.

The device of the present invention is designed so that the tape 32 will not advance until the cartridge is pushed firmly against the floor. Thus, if the cartridge is pressed relatively gently against the floor, even though the pressure would be sufficient to remove litter, the cartridge would not be retracted a sufficient distance into the housing to actuate the tape advance means. This result can be accomplished by designing a predetermined clearance space between the gears or teeth of wheels 23 and 33 when the cartridge is disposed within the housing 11 in its fully exposed or non-retracted position. In this manner, the movement of wheel 23 will not be transmitted to wheel 33 unless and until wheel 23 is retracted a predetermined distance into the housing. In the alternative, the ratchet rod 19 can be mounted relative to the cogged wheel 22 such that the gear teeth of the wheel 22 and those of the rod 19 will not engage until the cartridge is retracted sufficiently to move the wheels 22 and 23 a predetermined distance up the channel 26. It will be apparent that various other suitable alternatives can be devised without departing from the invention. Thus, this minimum predetermined distance can be controlled by varying the relative sizes of the cogged wheels, the size and configuration of the cartridge, the position of the channel 25 in the plate 21, and the like, and in a preferred embodiment is from about ¼ to about ¾ inch.

As illustrated, the tape supply reel 27 is provided with a cogged wheel 29 and cooperating lever mechanism 31 to prevent free-reel dispensing of tape 32 when the device is being used to remove litter from the floor. In the illustrated embodiment the cogged wheel 29 is mounted on the axel of the reel 27 and the lever mechanism 31 is mounted inside the cartridge 12.

While a preferred embodiment of the present invention has been set forth above, it will be apparent that many changes and modifications may be made without departing from the spirit and scope of the invention. It will therefore be understood that the embodiments, including the particular configurations and sizes thereof and methods of operation are intended to be illustrative only, and are not intended to limit the scope of the invention as set forth in the claims.

What is claimed is:

1. An adhesive tape device for removing litter from carpets, rugs and the like, which comprises:

a housing adapted to receive to a tape cartridge means;

tape cartridge means adapted to be removably fitted into said housing, said cartridge means comprising a first reel for supplying a length of tape and a second reel for taking up said length of tape, said cartridge being movable within said housing from a first extended position to a second retracted position;

biasing means mounted in said housing for normally disposing said cartridge in said first extended position; and tape advancing means mounted on said housing for rotating said second reel to thereby advance a length of tape from said first reel in response to a sequential movement of said cartridge from said first extended position to said second retracted position and back to said extended position, said length of tape having an outwardly facing tacky surface, a portion of said tacky surface being positioned outside of said housing and being adapted to contact the litter to be removed when said cartridge is in said retracted position, said extended position and all intermediate positions therebetween.

2. The device of claim 1, further comprising handle means mounted on said housing.

3. The device of claim 2, wherein said housing further comprises spring clip means, wherein said cartridge means comprises tab members, and wherein said tab members are releasably gripped by said spring clip means to removablely secure said cartridge within said housing.

4. The device of claim 2, wherein said biasing means comprises spring means mounted within said housing so as to contact and force said cartridge means to said first extended position.

5. The device of claim 3, wherein said biasing means comprises spring means mounted within said housing so as to contact and force said cartridge means to said first extended position.

6. The device of claim 3, wherein said cartridge means further comprises first cogged wheel means fixedly mounted to said second reel for rotation therewith, and wherein said tape advancing means comprised rack means, second and third cogged wheel means and lever means, said rack means being mounted to said housing for movement relative to said second and third cogged wheel means so as to impart rotational movement in a first direction to said second cogged wheel means in response to movement of said cartridge means toward said retracted position and to impart rotational movement to said second cogged wheel means in a second opposite direction in response to movement of said cartridge means to said extended position, said lever means being mounted on said second cogged wheel means for movement therewith, said lever means being operatively connected to said third cogged wheel means and being adapted to move said third cogged wheel means only when said second cogged wheel means rotates in said second direction, said third cogged wheel means being operatively connected to said first cogged wheel means so as to impart rotational movement to said first cogged wheel means only in said first direction such that when said cartridge means is moved from said extended position to said retracted position and back to said extended position said first cogged wheel means is rotated in said first direction to thereby rotate said second reel in said first direction and thereby advance said tape from said first reel.

7. The device of claim 4, wherein said cartridge means further comprises first cogged wheel means fixedly mounted to said second reel for rotation therewith, and wherein said tape advancing means comprised rack means, second and third cogged wheel means and lever means, said rack means being mounted on said housing for movement relative to said second and third cogged wheel means so as to impart rotational movement in a first direction to said second cogged wheel means in response to movement of said cartridge means toward said retracted position and to impart rotational movement to said second cogged wheel means in a second opposite direction in response to movement of said cartridge means to said extended position, said lever means being mounted on said second cogged wheel means for movement therewith, said lever means being operatively connected to said third cogged wheel means and being adapted to move said third cogged wheel means only when said second cogged wheel means rotates in said second direction, said third cogged wheel means being operatively connected to said first cogged wheel means so as to impart rotational movement to said first cogged wheel means only in said first direction such that when said cartridge means is moved from said extended position to said retracted position and back to said extended position said first cogged wheel means is rotated in said first direction to thereby rotate said second reel in said first direction and thereby advance said tape from said first reel.

8. The device of claim 5, wherein said cartridge means further comprises first cogged wheel means fixedly mounted on said second reel for rotation therewith, and wherein said tape advancing means comprised rack means, second and third cogged wheel means and lever means, said rack means being mounted on said housing for movement relative to said second and third cogged wheel means so as to impart rotational movement in a first direction to said second cogged wheel means in response to movement of said cartridge means toward said retracted position and to impart rotational movement to said second cogged wheel means in a second opposite direction in response to movement of said cartridge means to said extended position, said lever means being mounted on said second cogged wheel means for movement therewith, said lever means being operatively connected to said third cogged wheel means and being adapted to move said third cogged wheel means only when said second cogged wheel means rotates in said second direction, said third cogged wheel means being operatively connected to said first cogged wheel means so as to impart rotational movement to said first cogged wheel means only in said first direction such that when said cartridge means is moved from said extended position to said retracted position and back to said extended position said first cogged wheel means is rotated in said first direction to thereby rotate said second reel in said first direction and thereby advance said tape from said first reel.

9. The device of claim 6, wherein said cartridge means further comprises means to restrict free reeling of said first reel means.

10. The device of claim 9, wherein said free reeling restricting means comprises forth cogged wheel means fixedly mounted to said first reel for rotation therewith and second lever means mounted on said cartridge means and operatively connected to said forth cogged wheel means to restrict but not preclude rotation of said fourth cogged wheel means.

11. The device of claim 7, wherein said cartridge means further comprises means to restrict free reeling of said reel means.

12. The device of claim 8, wherein said cartridge means further comprises means to restrict free reeling of said reel means.

* * * * *